US008590756B2

(12) United States Patent
Baker et al.

(10) Patent No.: US 8,590,756 B2
(45) Date of Patent: Nov. 26, 2013

(54) CONTAINER WITH TUBE DRAWING DESIRED FLUID CONCENTRATIONS FOR MICRO-FLUID APPLICATIONS

(75) Inventors: Marc Frazier Baker, Georgetown, KY (US); Neal David Erickson, Lexington, KY (US); Mark Doerre, Lexington, KY (US); Alan Anthony Bidwell, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 217 days.

(21) Appl. No.: 13/094,107

(22) Filed: Apr. 26, 2011

(65) Prior Publication Data

US 2012/0273529 A1 Nov. 1, 2012

(51) Int. Cl.
*B67D 7/78* (2010.01)

(52) U.S. Cl.
USPC ..... 222/464.6; 347/1; 347/7; 347/84

(58) Field of Classification Search
USPC ..... 222/464.6, 181.1, 185.1; 347/7
See application file for complete search history.

(56) References Cited

U.S. PATENT DOCUMENTS

| | | | | |
|---|---|---|---|---|
| 3,172,581 | A * | 3/1965 | Nanni | 222/464.6 |
| 3,876,282 | A | 4/1975 | Schon | |
| 6,312,113 | B1 | 11/2001 | Murad | |
| 6,742,881 | B2 | 6/2004 | Kotaki | |
| 6,817,705 | B1 | 11/2004 | Crockett | |
| 7,618,133 | B2 | 11/2009 | Kubo | |
| 7,735,984 | B2 | 6/2010 | Iijima | |
| 2008/0062231 | A1 | 3/2008 | Kubo | |
| 2010/0053280 | A1 | 3/2010 | Ohashi | |

FOREIGN PATENT DOCUMENTS

| | | | |
|---|---|---|---|
| JP | 2001260377 | A | 9/2001 |
| JP | 2001260378 | A | 9/2001 |
| JP | 2001260379 | A | 9/2001 |
| JP | 2004216761 | A | 8/2004 |
| JP | 2005066520 | A | 3/2005 |
| JP | 2007230189 | A | 9/2007 |

* cited by examiner

*Primary Examiner* — Kevin P Shaver
*Assistant Examiner* — Michael J Melaragno
(74) *Attorney, Agent, or Firm* — Amster, Rothstein & Ebenstein LLP

(57) ABSTRACT

A consumable supply item for an imaging device holds an initial or refillable volume of pigmented ink. Its housing defines an interior and a fluid exit port. Users orient the housing to deplete the ink in a downward direction. A float on a surface of the ink suspends an inlet opening of a fluid conduit tube underneath the surface. A height of the opening falls downward as the fluid depletes and the float drops. The tube draws a desired concentration of ink and supplies it to the exit port. The concentration is predetermined relative to an overall height of the fluid. The tube height remains proportional to the height of the fluid, increases/decreases proportionally, or other. The design overcomes settling. The design also avoids mechanical stirring and other complex sediment mixing techniques. Embodiments include float/tube arrangements and testing observations, to name a few.

15 Claims, 4 Drawing Sheets

CONTAINER WITH TUBE DRAWING DESIRED FLUID CONCENTRATIONS FOR MICRO-FLUID APPLICATIONS

FIELD OF THE INVENTION

The present invention relates to micro-fluid applications, such as inkjet printing. More particularly, although not exclusively, it relates to supply item containers overcoming settling of pigmented ink. Fluid tubes facilitate certain designs.

BACKGROUND

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. The fluid is typically dye or pigment based ink. Dye ink is traditionally cheap with a broad gamut of colors. Pigmented ink is generally more expensive, but has longer permanence and higher color stability.

Pigmented ink is also known over time to settle downward in a container leaving rich sediment concentrations near a bottom, while leaner sediment concentrations remain near a top. When printing, ink drawn from a floor of a settled container leads first to excessively densely printed colors and later to excessively lightly printed colors. The variation causes unacceptable visible defects. The former can lead also to clogging of ejection head nozzles if large particles accumulate together in micron-sized channels having fastidious fluid flow standards.

By applying either the Mason/Weaver equation to particle sedimentation, or a numerical analysis using finite element modeling, for instance, the particle concentration of pigment in a container can be fairly predicted over time. In either, locations are revealed in a container where present concentrations match initial concentrations regardless of the length of settling time (also known as the Mason/Weaver invariant point). To accommodate drawing fluid from this point, some manufacturers have raised fluid exit ports to heights measurably higher than floors of containers. While it avoids supplying ink to a printing or imaging device having too dense a concentration, it prevents full use of a container's contents as appreciable amounts of ink rest below the exit port on lowermost surfaces of the container. In turn, some have introduced collapsing container walls to squeeze ink toward the exit port while still maintaining the location of the exit port above the bottom. This unfortunately introduces expense into the manufacturing process and complicates design as pressure regulating devices are sometimes needed.

In other solutions, containers are known with mechanical stir bars or agitating members that roil ink and mix sediments before and during use. While nominally effective, the approach causes expensive/complex manufacturing and necessitates motive force to set agitating bodies into motion. Still other designs contemplate the use of Galileo balls, heaters, agitation by external forces (such as movement of a tank carrier), ink recycling, vibration, posts, segmented tanks, shelves, stand pipes, or multiple fluid ports, to name a few. Most are ineffective or impractical. None provide economic advantage or acceptable relief across all facets of design, manufacturing and use.

Accordingly, a need exists in the art to deliver imaging devices an entirety of pigmented ink in a container. The need extends not only to an economical solution but to delivering ink in a manner that its concentration has uniform properties over the life of the container, independent of usage rate, temperature or other imaging device conditions. Additional benefits and alternatives are also sought when devising solutions.

SUMMARY

The above-mentioned and other problems become solved with containers having fluid conduit tubes drawing desired fluid concentrations for micro-fluid applications. The tubes draw fluid from heights where pigment concentrations match initial homogeneous concentrations, e.g., the Mason/Weaver invariant point. As this height relates to a height of the current fluid level, features adjust the tube inlet to remain at an appropriate height even as fluid levels decrease over time or increase upon refilling. As fluid draws into the tube, optimum amounts of sediments are realized for imaging operations. High-concentrated fluid is drawn closer to a bottom of a container while less concentrated fluid is drawn from higher. Tailoring the concentration of the draw is still another aspect.

In a representative embodiment, a consumable supply item for an imaging device holds an initial or refillable volume of pigmented ink. Its housing defines an interior and a fluid exit port. Users orient the housing to deplete the ink in a direction of gravity toward a bottom of the interior. A float on a surface of the ink suspends an inlet opening of a fluid conduit tube underneath the surface. A height of the opening falls ever downward as the fluid depletes and the float drops. The tube draws a desired concentration of ink and supplies it to the exit port. The concentration is predetermined relative to an overall height of the fluid. The tube height remains always proportional to the height of the fluid, increases or decreases proportionally as constraints dictate, or other. The design overcomes settling. The design also avoids mechanical stirring and other complex sediment mixing techniques. It adds little cost yet provides substantial value over a lifetime of usage.

Further embodiments contemplate interaction between the float and tube. In one design, a lever connects to each the float and tube. A fulcrum attaches to the lever to rotate the lever toward the bottom surface of the container as the float falls upon the depletion of the volume of fluid in the interior. The fulcrum resides at a top or bottom of the container, or elsewhere. The lever is either straight, curved, or complexly shaped. Other designs add a pinned slide to the lever. The fluid conduit tube attaches directly to the pinned slide while the float attaches directly to the lever at a distal end.

These and other embodiments are set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, containers have tubes drawing desired concentrations of fluid that overcome settling problems associated with pigmented ink in micro-fluid applications.

Figure 1A:
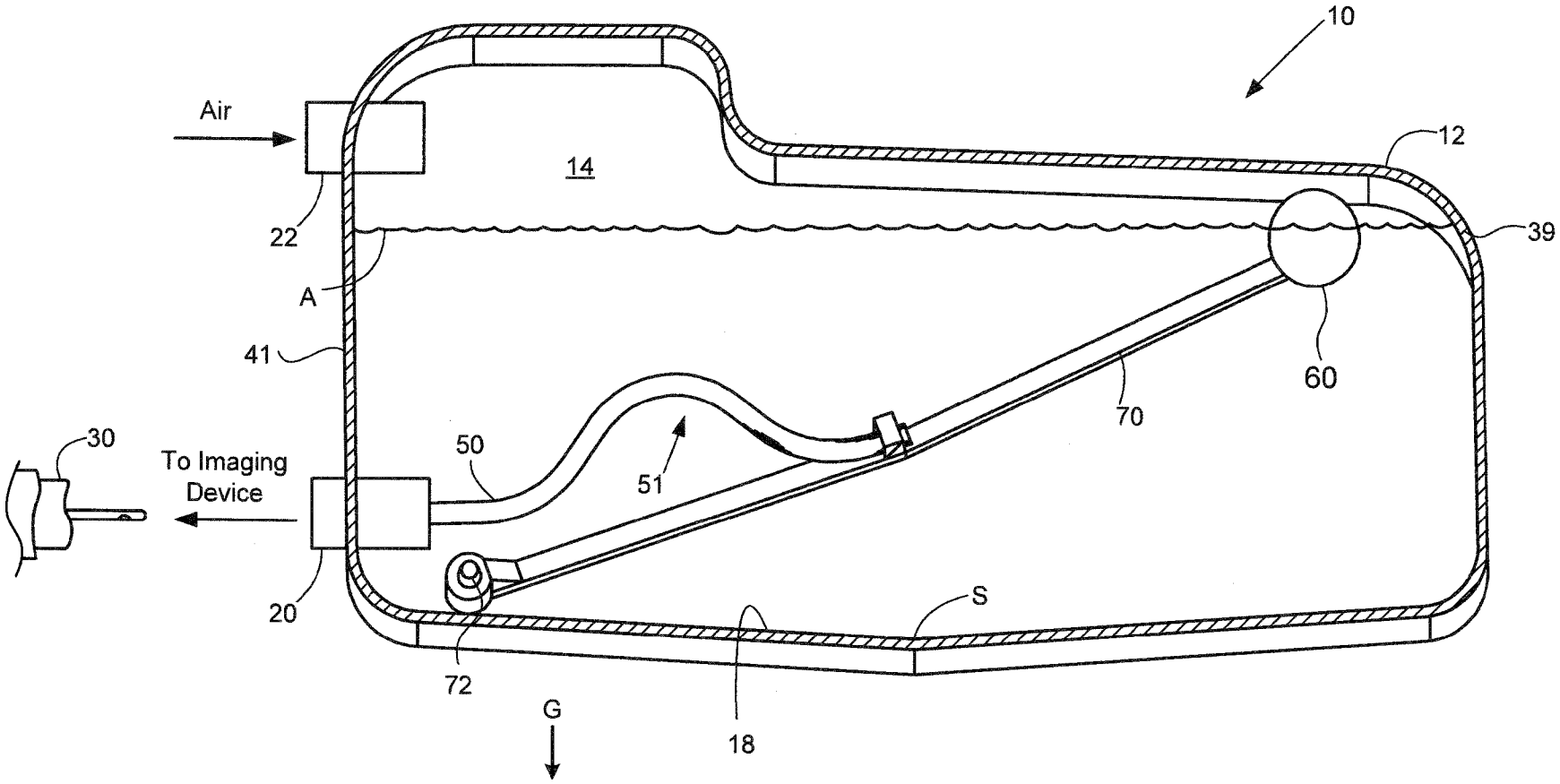
FIGS. 1A and 1B are diagrammatic views in accordance with the present invention showing containers with fluid conduit tubes in differing heights of fluid.
Figure 1B:
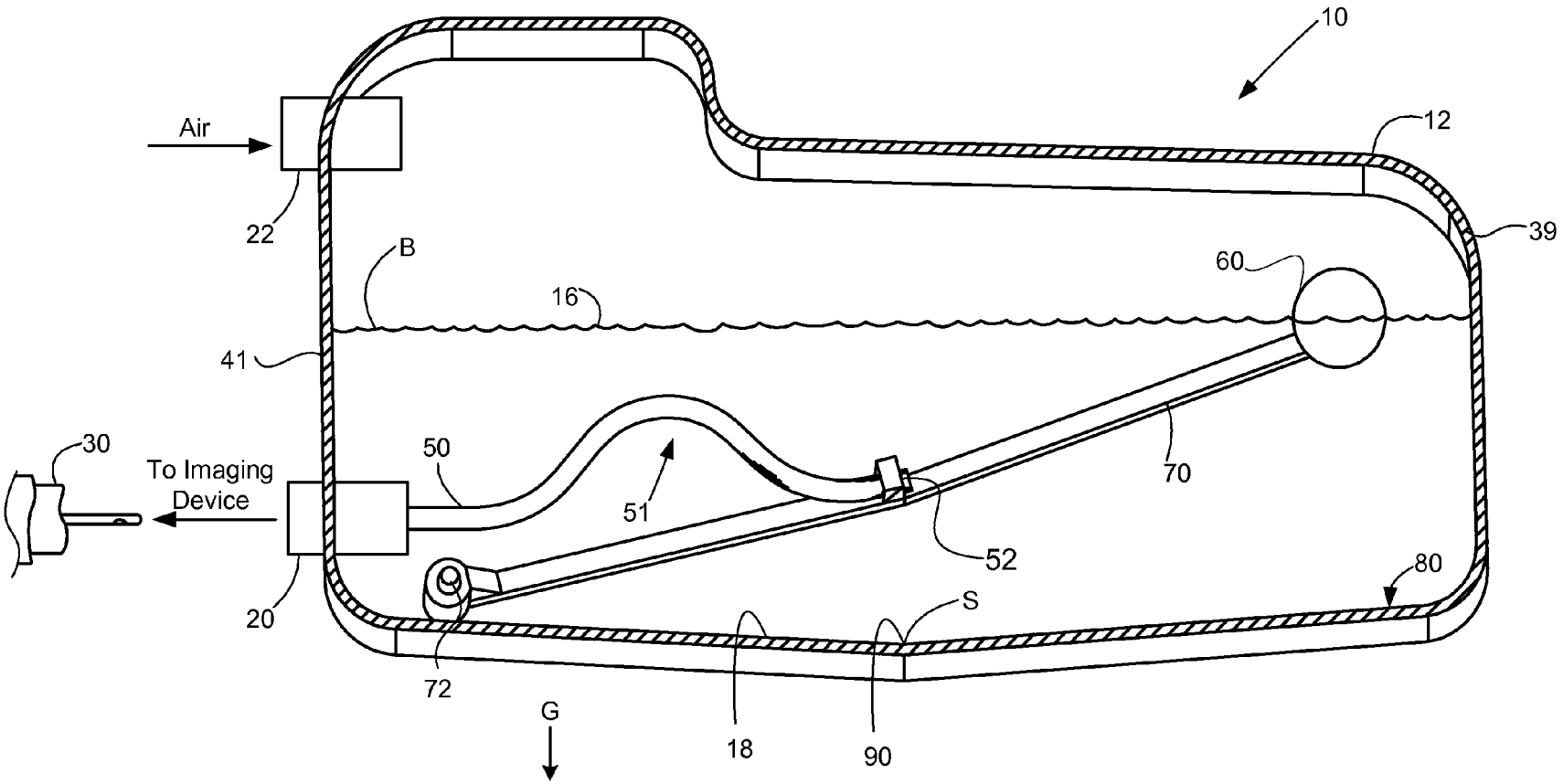

With reference to FIGS. 1A and 1B, a supply item container 10 for use in an imaging device includes a housing 12. The housing defines an interior 14 that contains an initial or refillable supply of fluid, e.g. ink 16. The fluid is any of a variety of aqueous inks, such as those based on dye or pigmented formulations. It also typifies varieties of color, such as cyan, magenta, yellow, black, etc. The item is useful in many applications such as inkjet printing, medicinal delivery, forming circuit traces, food processing, chemical manufacturing, etc.

During use, the volume of ink depletes downward toward a bottom surface 18 of the interior of the housing in a direction of gravity G. The bottom surface is generally flat or concaved upward to define a low point area or sump S for drawing the last vestiges of ink. The ink flows out of the housing to the imaging device by way of an exit port 20. An air venting port 22 provides intake of ambient, recycled or other air to overcome backpressure that increases during imaging operations. The ports are any of a variety but typify cylindrical tubes biased shut with an internal ball and spring (not shown). They are mated with a septum needle 30 from the imaging device. The needle inserts into the ports to overcome the bias of the spring and the ball slides backward. Upon sufficient insertion, openings in the port and needle are communicated so that a fluidic channel opens between the interior 14 of the housing and the needle. Fluid exits through port 20. The fluid is drawn to the port from the interior by a fluid conduit tube 50.

The fluid tube connects at one end to the port and at the other end to a lever 70. The lever has a fulcrum 72. The lever also attaches to a float 60 buoyantly positioned on a surface of the volume of fluid. As fluid in the interior depletes from fluid level A to B, for example, the float 60 correspondingly drops in height. The drop causes the lever to rotate downward about the fulcrum. As the distal end of the fluid tube is attached to the rotating lever, an inlet opening 52 of the tube similarly rotates downward. With depleting fluid, the inlet opening decreases in height ever downward. The height increases, conversely, upon refilling of fluid within the interior. A desired concentration of fluid is drawn into the inlet opening 52 above the bottom surface 18 of the container.

As the location of the inlet opening along a length of the lever can be manipulated closer or farther the fulcrum or float, as too its height can be arranged beneath the surface of the volume of fluid along the lever or above/below the lever, the richness or leanness of sediment drawn to the exit port 20 can be modified to draw predetermined amounts. In the present embodiment, similar triangles are defined by a first set of three points, e.g., fulcrum 72, float 60, and projection 80 of the float on the bottom of the interior, and a second set of three points, e.g., fulcrum 72, inlet opening 52 and projection 90 of the inlet opening on the bottom of the interior, regardless of the amount of fluid in the interior. In turn, the ratio remains fixed between the fluid intake height at the inlet opening 52 above the bottom 18 and the current fluid fill level, e.g., fluid level A or B. In this manner, the inlet opening 52 draws fluid having a concentration (regardless of the level of fluid in the interior) that matches the initial homogeneous concentration of the supply item when originally full and the Mason/Weaver invariant point is satisfied. No longer is it necessary to draw rich concentrations of fluid from the bottom surface or too lean concentrations from locations high above the bottom. It is also no longer necessary to use complex stirring techniques.

Figure 2:
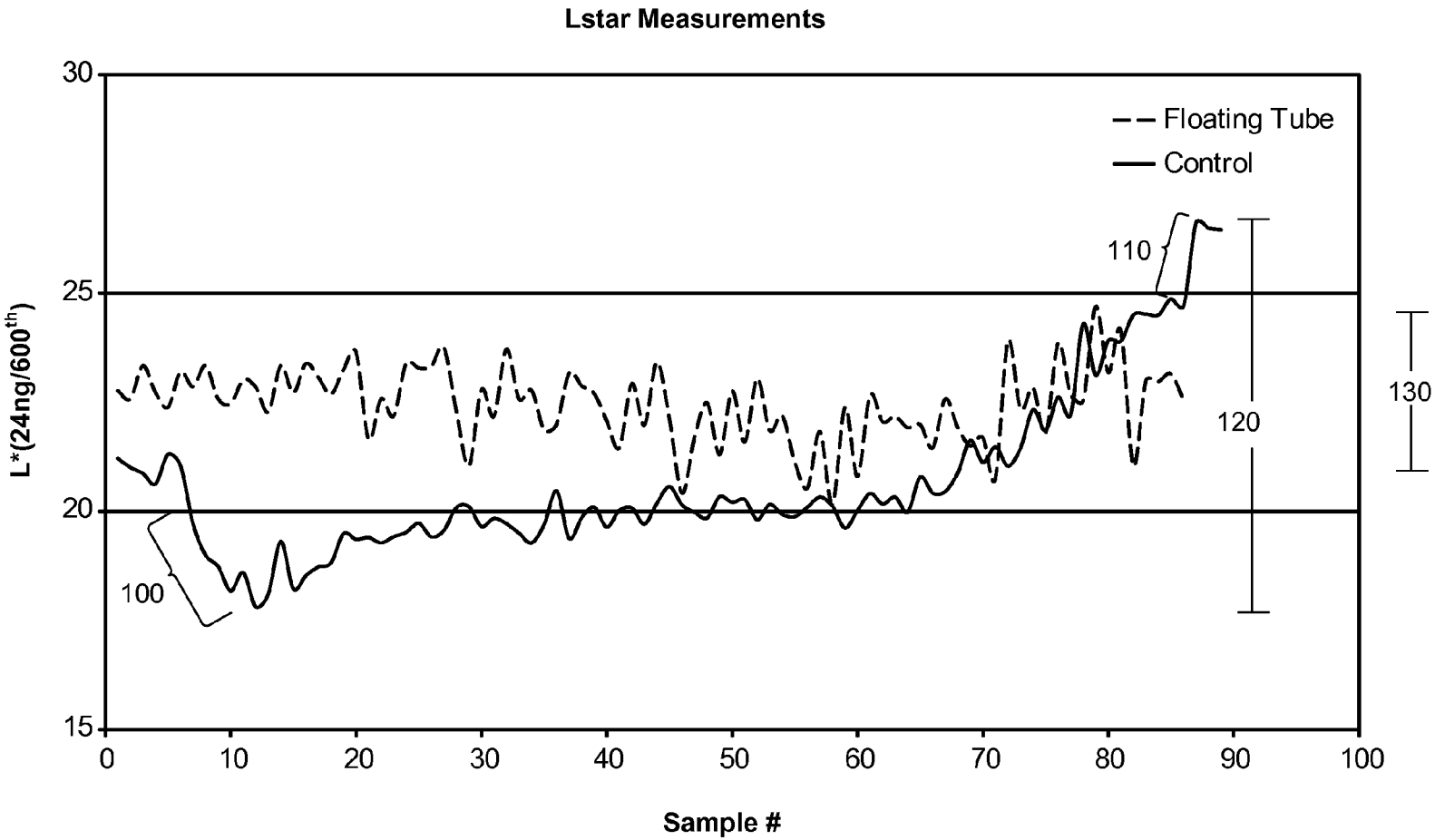
FIG. 2 is a graph showing improved imaging over conventional containers.

With reference to FIG. 2, samples of fluid in a supply item were drawn from an inlet opening of a "floating tube" (e.g., FIG. 1) over an extended length of time and compared to "control" samples having fluid drawn directly to an exit port of a supply item. As is seen, minimal luminance (L Star (L*)) measurements of black prints after pigment settling show a performance improvement in the floating tube design. Along the lifetime of measurement, the L* of the floating tube varies within a stable range 130 of only about 4.6. The control design, on the other hand, shows an initial drop 100 from a starting concentration as rich ink is first pulled from a container and a final rise 110 corresponding to drawing of exceptionally dilute ink. Its L* varies nearly double that of the floating tube design in a range 120 of about 8.8. The results imply an improved consistency of pigment concentration delivered with the floating tube concept.

Figure 3C:
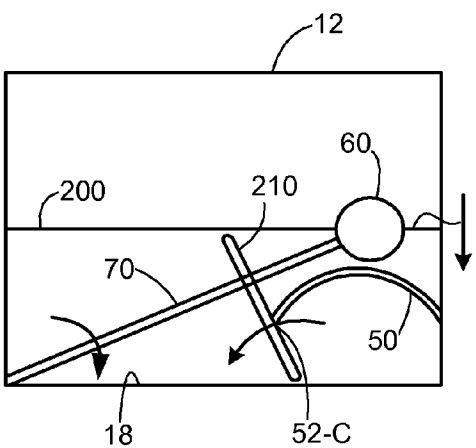
FIGS. 3A-3C are diagrammatic views of alternate embodiments of containers.
Figure 3B:
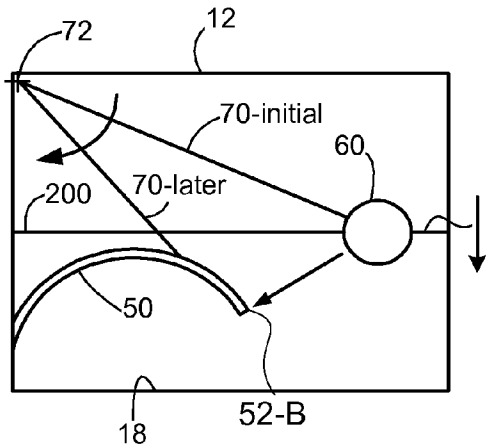
Figure 3A:
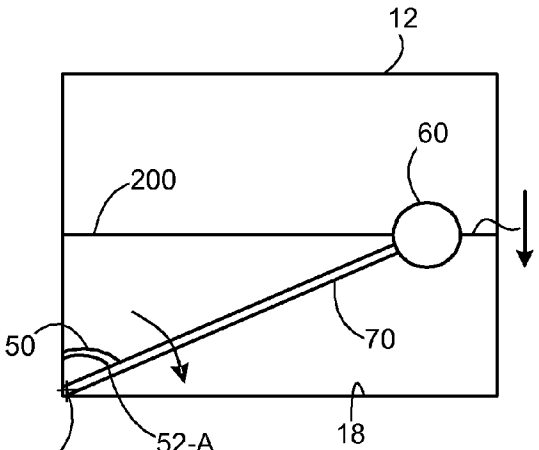

In other embodiments, pigment density can be "tuned" by varying the location of the fluid conduit tube and its inlet opening, as noted above, and/or relocating the fulcrum, alternately shaping the lever, or providing additional structures within the container, etc. The techniques seek tuning that increases or decreases amounts of sediments drawn into the tube at a particular time, fluctuates the amount of sediments drawn into the tube over the lifetime of a container, draws always lightly or richly concentrated fluid, draws first a lean concentration and later a rich concentration, draws a controlled increase or decrease in concentration as fluid depletes, etc. For example, the embodiments of FIGS. 3A-3C are provided. They reveal concepts to vary the height of the inlet opening 52 above the bottom surface 18 of a container at which fluid is drawn from a reservoir as a function of the total height of fluid level 200 in the reservoir.

Figure 4:
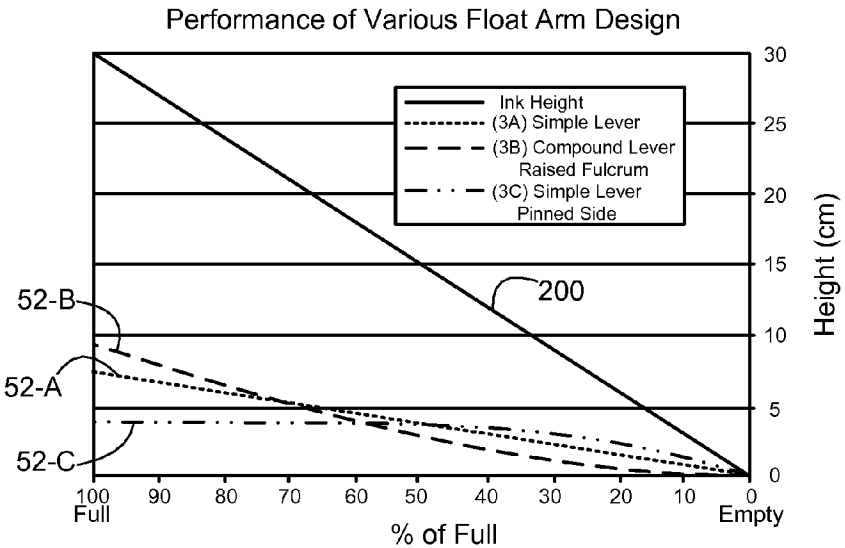
FIG. 4 is a graph of performance results.

In FIG. 3A, the inlet opening 52-A is moved closer to the fulcrum along the lever 70, as compared to FIG. 1. As the float decreases in height with decreasing fluid level, the inlet opening decreases ever downward. The inlet opening is fashioned to sit at one-fourth (¼) the total height of the fluid level 200, regardless of how far the fluid level falls. In FIG. 3B, the inlet opening 52-B has a decreasing proportion of the total fluid height (in this example 30% when full to 3% when almost empty). It also notes a fulcrum 72 above the fluid tube and float and generally above a present fluid level. In FIG. 3C, the inlet opening 52-C has an increasing proportion of the total fluid height (in this example 13% when full to 50% when almost empty). It includes a pinned slide 210 attached to the lever 70, whereby the fluid conduit tube 50 attaches directly to the pinned slide beneath the leaver and the float 60 attaches directly to the lever. With reference to FIG. 4, test data reveals the heights of the inlet openings 52-A,B,C relative to the fluid level 200 along a lifetime of usage from full to empty. Of course, other designs are possible to tailor the foregoing as are other geometries to tailor other responses.

Regardless of design, common constraints are noted. It is expected that the fluid conduit tube is formed of a material that is compatible with the fluid over a lifetime of usage and is flexible to move. Polypropylene is one such material and is commercial available under the trade name "Tygon." A length of the material will vary according to its positioning in the interior, but may be set with a kink 51 (FIGS. 1A and 1B) so that as the lever rotates, the tube can extend and reach the inlet opening 52 to an appropriate section of the interior. A diameter of the tube will be largely dictated by the fluid flow constraints of the accompanying imaging device that is being supplied with fluid from the supply item 10.

The float 60 is envisioned as a low density Styrofoam. As the volume of the float consumes space within the interior 14 of the container that could otherwise be filled with fluid, a smaller volumetric float is contemplated rather than a larger float. The float must be also of a composition that avoids absorption of fluid, otherwise its intended function is potentially jeopardized. Its shape is any of a variety, but spherical is the likeliest of candidates.

Similarly, the lever is of a material that finds compatibility with the fluid over a lifetime of usage and its volume is minimized to make space available for fluid in the interior. Its shape is varied, but a lengthy straight lever is envisioned foremost. Alternatively, the lever is curved or fancifully shaped. The lever can also be eliminated as the float can attach (in)directly to the fluid conduit tube. In such embodiments, the float connects to the tube, such as by weld, or by intermediate structures, such as by wire that hangs the tube in the volume of fluid beneath the float.

The housing itself is any of a variety of containers for holding ink. It can typify plastics, glass, metal, etc. It can be recyclable or not. It can contemplate simplicity or complexity. Techniques for production are varied, but blow molding, injection molding, etc. are common techniques. Welding, heat-staking, bonding, dies, etc. are also envisioned. The materials, construction, shipping, storage, use, etc. of the housing can also focus on criteria, such as costs, ease of manufacturing, durability, or a host of other items. Its shape is nearly infinite. Implicating its selection are good engineering practices, such as contemplation of a larger imaging context in which the housing will be used. In the design given, the housing is generally elongated from its back end 39 to its port end 41. The port end inserts forward into an imaging device as the back end is pushed by users. The shape also contemplates seals and septums, or the like, which may find utility in the design to prevent leakage. Other fluid communication channels can also be used.

Relatively apparent advantages of the many embodiments include, but are not limited to: (1) delivering essentially all the fluid in a container to an imaging device; (2) delivering the fluid in such a manner that the pigment concentration of the ink exiting the container has uniform properties over the lifetime of the container; (3) delivering uniformly pigmented ink, independent of usage rate, temperature or other typical conditions in an imaging environment; (4) tailoring a location above a bottom surface of a container for drawing fluid as a function of a present fluid level in the container over a lifetime of usage of the fluid; and (5) providing passive mixing of pigmented ink without needing mechanical stir bars or other complex mechanisms.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A container to hold an initial or refillable volume of fluid, comprising: a housing defining a fluid exit port and an interior to retain the volume of fluid, the interior being oriented during use to deplete the volume of fluid in a direction of gravity toward a bottom surface of the interior; a fluid conduit tube having an inlet opening in the interior and fluidly connected to the fluid exit port to draw from the interior and supply to the fluid exit port a desired concentration of fluid from the volume of fluid; and a float for buoyant positioning on a surface of the volume of fluid, the float connecting to the fluid conduit tube to suspend the inlet opening beneath the surface of the volume of fluid such that as the volume of fluid depletes in the interior over time the float drops as does the inlet opening to draw the desired concentration of fluid from an ever decreasing height above the bottom surface of the interior, wherein the inlet opening extends into the interior at a height above the bottom surface at a predetermined ratio relative to a height of the surface of the volume of fluid above said bottom surface; and the predetermined ratio is about one half over a lifetime of usage of the volume of fluid.

2. The container of claim 1, further including a lever commonly attaching to both the fluid conduit tube and the float.

3. The container of claim 2, further including a fulcrum attaching to the lever to rotate the lever toward the bottom surface as the float said drops upon the depletion of the volume of fluid in the interior.

4. The container of claim 3, wherein the fulcrum attaches at the bottom surface of the interior.

5. The container of claim 3, wherein the fulcrum attaches to a terminal end of the lever and the float attaches to a terminal opposite end of the lever.

6. The container of claim 2, wherein the lever is substantially straight along a length thereof.

7. The container of claim 1, wherein the inlet opening extends into the interior at a level above the bottom surface at a decreasing proportion relative to a height of the surface of the volume of fluid above said bottom surface.

8. The container of claim 2, further including a pinned slide attached to the lever, the fluid conduit tube attaching directly to the pinned slide, the float attaching directly to the lever.

9. A container to hold an initial or refillable volume of fluid, comprising: a housing defining a fluid exit port and an interior to retain the volume of fluid, the interior being oriented during use to deplete the volume of fluid in a direction of gravity toward a bottom surface of the interior; a fluid conduit tube having an inlet opening in the interior and fluidly connected to the fluid exit port to draw from the interior and supply to the fluid exit port a desired concentration of fluid from the volume of fluid; and a float for buoyant positioning on a surface of the volume of fluid, the float connecting to the fluid conduit tube to suspend the inlet opening beneath the surface of the volume of fluid at an ever decreasing height above the bottom surface of the interior such that as the volume of fluid depletes in the interior the float decreases in height as does the inlet opening to draw the desired concentration of fluid until the inlet opening substantially reaches the bottom surface, wherein the inlet opening above the bottom surface of the interior is configured with the float to have said ever decreasing height as a predetermined ratio relative to a height of the surface of the volume of fluid above said bottom surface over a lifetime of usage of the volume of fluid; and the predetermined ratio is about one half over a lifetime of usage of the volume of fluid.

10. The container of claim 9, wherein the float attaches directly to the fluid conduit tube.

11. The container of claim 9, further including a lever commonly attaching to both the fluid conduit tube and the float.

12. The container of claim 11, further including a fulcrum attaching to the lever to rotate the lever toward the bottom surface as the float said decreases in height upon the depletion of the volume of fluid in the interior.

13. The container of claim 11, further including a pinned slide attached to the lever, the fluid conduit tube attaching directly to the pinned slide, the float attaching directly to the lever.

14. The container of claim 9, wherein the inlet opening above the bottom surface of the interior is configured with the float to have said ever decreasing height as a decreasing proportion of fluid height relative to a height of the surface of the volume of fluid above said bottom surface over a lifetime of usage of the volume of fluid.

15. A container to hold an initial or refillable volume of fluid, comprising: a housing defining a fluid exit port and an interior to retain the volume of fluid; a fluid conduit tube having an inlet opening in the interior and fluidly connected to the fluid exit port to draw from the interior and supply to the fluid exit port a desired concentration of fluid from the volume of fluid; a float for buoyant positioning on a surface of the volume of fluid, the float connecting to the fluid conduit tube to suspend the inlet opening in the volume of fluid beneath the surface so that as the volume of fluid depletes in the interior over time the float drops in height as does the inlet opening to draw the desired concentration of fluid from an ever decreasing height above the bottom surface of the interior; a lever commonly attaching to both the fluid conduit tube and the float; and a fulcrum attaching to the lever to rotate the lever toward the bottom surface as the float said decreases in height upon the depletion of the volume of fluid in the interior; wherein the inlet opening extends into the interior at a height above the bottom surface at a predetermined ratio relative to a height of the surface of the volume of fluid above said bottom surface; and the predetermined ratio is about one half over a lifetime of usage of the volume of fluid.

* * * * *